US010837442B2

(12) United States Patent
Hirano et al.

(10) Patent No.: US 10,837,442 B2
(45) Date of Patent: Nov. 17, 2020

(54) VARIABLE OIL PUMP

(71) Applicant: AISIN SEIKI KABUSHIKI KAISHA, Kariya (JP)

(72) Inventors: Takashi Hirano, Kariya (JP); Atsuo Isoda, Toyoake (JP); Takahiro Sakai, Anjo (JP)

(73) Assignee: AISIN SEIKI KABUSHIKI KAISHA, Kariya (JP)

( * ) Notice: Subject to any disclaimer, the term of this patent is extended or adjusted under 35 U.S.C. 154(b) by 345 days.

(21) Appl. No.: 15/757,509

(22) PCT Filed: Sep. 9, 2016

(86) PCT No.: PCT/JP2016/076621

§ 371 (c)(1),
(2) Date: Mar. 5, 2018

(87) PCT Pub. No.: WO2017/051729

PCT Pub. Date: Mar. 30, 2017

(65) Prior Publication Data

US 2018/0245589 A1 Aug. 30, 2018

(30) Foreign Application Priority Data

Sep. 24, 2015 (JP) ..... 2015-186544

(51) Int. Cl.
*F04C 14/22* (2006.01)
*F04C 2/344* (2006.01)
(Continued)

(52) U.S. Cl.
CPC ..... *F04C 14/226* (2013.01); *F01C 21/0863* (2013.01); *F01M 1/16* (2013.01);
(Continued)

(58) Field of Classification Search
CPC ..... F04C 14/226; F04C 14/22; F04C 2/10; F04C 2/102; F04C 15/0026;
(Continued)

(56) References Cited

U.S. PATENT DOCUMENTS 4,531,893 A 7/1985 Okoh et al.
2010/0226799 A1* 9/2010 Watanabe ..... F04C 14/226 417/364
2010/0282204 A1* 11/2010 Zwickler ..... F04C 2/3442 123/196 R
(Continued)

FOREIGN PATENT DOCUMENTS

JP S-59-058185 A 4/1984
JP 2012-132356 A 7/2012
JP 2014-159761 A 9/2014

OTHER PUBLICATIONS

International Search Report (PCT/ISA/210) dated Nov. 29, 2016, by the Japanese Patent Office as the International Searching Authority for International Application No. PCT/JP2016/076621.
(Continued)

*Primary Examiner* — Deming Wan
(74) *Attorney, Agent, or Firm* — Buchanan Ingersoll & Rooney PC

(57) ABSTRACT

A variable oil pump includes a pump rotor housed in a housing and rotationally driven, an adjustment ring that adjusts an amount of oil discharged from the pump rotor by being displaced under hydraulic pressure supplied to a hydraulic chamber between the housing and the pump rotor in a state where the pump rotor is rotatably held from an outer peripheral side, and a vane provided in a portion where the adjustment ring and the housing face each other and that seals oil leakage to an outside of the hydraulic chamber. The adjustment ring includes a vane holding portion that holds the vane and an oil passage through which the hydraulic pressure in the hydraulic chamber is drawn into the vane holding portion.

7 Claims, 6 Drawing Sheets

(51) Int. Cl.

| | |
|---|---|
| ***F01C 21/08*** | (2006.01) |
| ***F04C 15/00*** | (2006.01) |
| ***F01M 1/16*** | (2006.01) |
| ***F04C 2/10*** | (2006.01) |
| ***F04C 14/18*** | (2006.01) |

(52) U.S. Cl.
CPC ..... *F04C 2/10* (2013.01); *F04C 2/102* (2013.01); *F04C 15/0026* (2013.01); *F04C 2210/206* (2013.01); *F04C 2270/185* (2013.01)

(58) Field of Classification Search
CPC .... F04C 15/0034; F04C 14/18; F04C 2/3442; F01C 21/0863; F01M 1/16
See application file for complete search history.

(56) References Cited

U.S. PATENT DOCUMENTS

| | | | | |
|---|---|---|---|---|
| 2013/0121867 | A1* | 5/2013 | Ebinger ..... | F04C 14/226 418/181 |
| 2013/0136644 | A1* | 5/2013 | Ju ..... | F01C 19/005 418/181 |
| 2015/0240808 | A1* | 8/2015 | Akatsuka ..... | F04C 2/3442 418/23 |

OTHER PUBLICATIONS

Written Opinion (PCT/ISA/237) dated Nov. 29, 2016, by the Japanese Patent Office as the International Searching Authority for International Application No. PCT/JP2016/076621.

* cited by examiner (FIRST EMBODIMENT)

ENLARGED VIEW AROUND VANE HOLDING PORTION

FIG.5 CROSS-SECTION TAKEN ALONG LINE 150-150
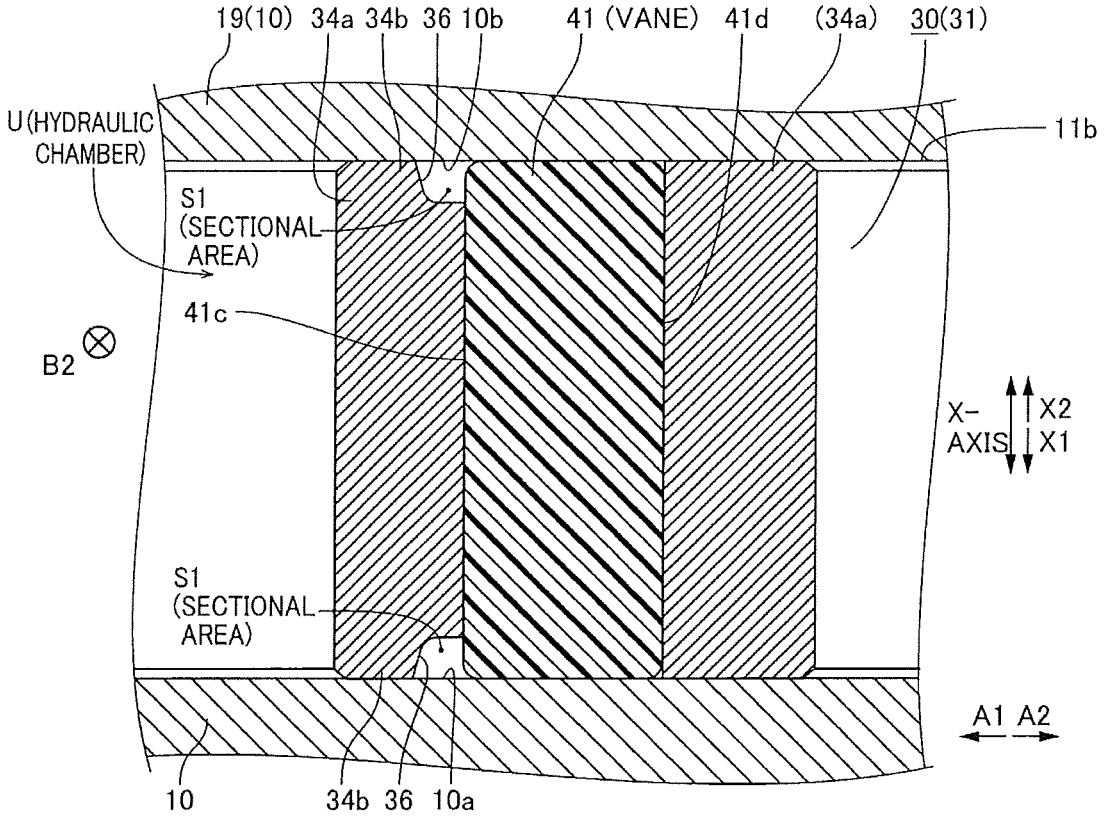
FIG.6 CROSS-SECTION TAKEN ALONG LINE 160-160
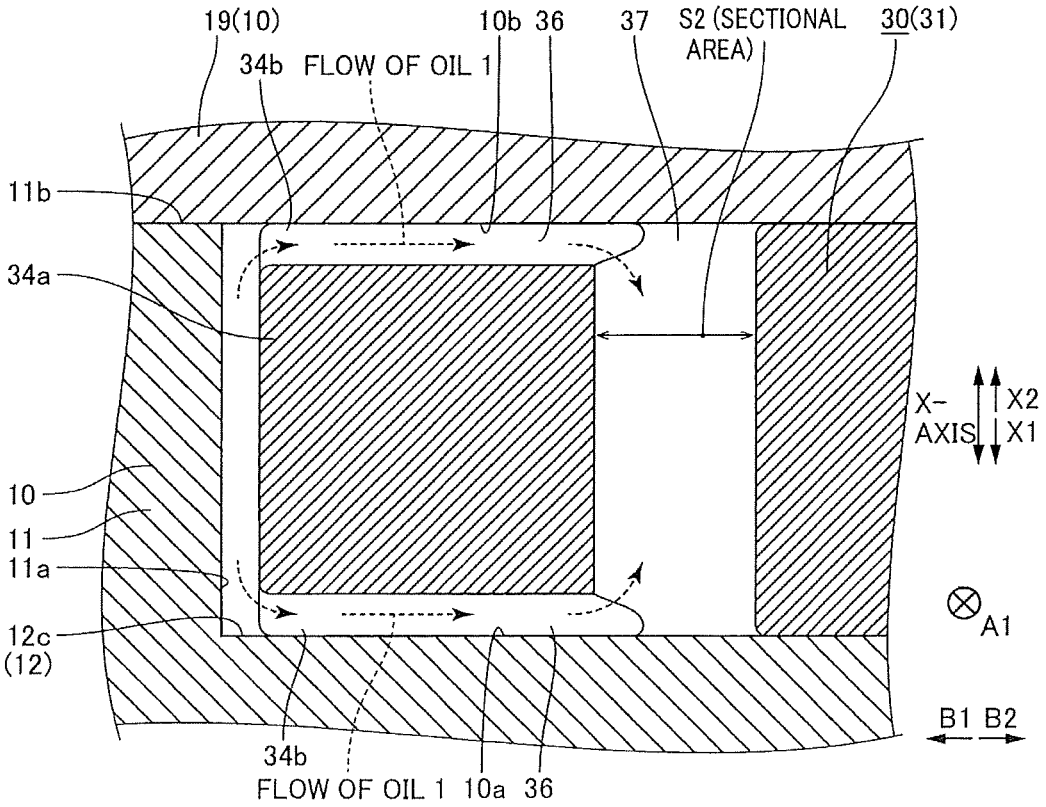

WHEN VANE AND LEAF SPRING ARE ASSEMBLED (MODIFICATION OF FIRST EMBODIMENT)

ENLARGED VIEW AROUND VANE HOLDING PORTION (SECOND EMBODIMENT)

ENLARGED VIEW AROUND VANE HOLDING PORTION

CROSS-SECTION TAKEN ALONG LINE 250-250

VARIABLE OIL PUMP

TECHNICAL FIELD

The present invention relates to a variable oil pump.

BACKGROUND ART

In general, a variable oil pump including a pump housing and an adjustment member that adjusts the amount of oil discharged from an oil pump rotor is known. Such a variable oil pump is disclosed in Japanese Patent Laying-Open No. 2014-159761, for example.

Japanese Patent Laying-Open No. 2014-159761 discloses a hydraulic controller that controls an oil pump (variable oil pump) including a variable displacement mechanism. The oil pump, the capacity of which is controlled by the hydraulic controller, described in Japanese Patent Laying-Open No. 2014-159761 includes a housing and an adjustment ring (adjustment member) that rotatably holds a driven rotor housed in the housing from the outer peripheral side. The adjustment ring is displaced due to hydraulic pressure, and hence the rotational center of the driven rotor with respect to the rotational center of a drive rotor is moved such that the discharge amount per rotation of the oil pump can be increased and decreased. Incidentally, a hydraulic chamber that applies hydraulic pressure to the adjustment ring is provided between a portion of the outer surface of the adjustment ring and the inner surface of the housing. A seal member that prevents oil leakage to the outside of the hydraulic chamber is disposed on a contact portion between the adjustment ring and the housing. The seal member is fitted into a recess (seal member holding portion) formed on the outer surface of the adjustment ring. The seal member is held slidably with respect to the inner surface of the recess, and a tip of the seal member is pressed against the inner surface of the housing with a predetermined pressing force.

PRIOR ART

Patent Document

Patent Document 1: Japanese Patent Laying-Open No. 2014-159761

SUMMARY OF THE INVENTION

Problem to be Solved by the Invention

However, in the oil pump (variable oil pump) described in Japanese Patent Laying-Open No. 2014-159761, once foreign matter contained in oil flows into the recess (gap) of the adjustment ring that holds the seal member during operation of the oil pump, the foreign matter has nowhere to escape such that the foreign matter is trapped in a gap portion at a root of the seal member. Therefore, there is a problem that the mobility of the seal member with respect to the inner surface of the recess is impaired due to the foreign matter caught in the recess (seal member holding portion).

The present invention has been proposed in order to solve the aforementioned problem, and an object of the present invention is to provide a variable oil pump capable of significantly reducing or preventing impairment of the mobility of a seal member held by a seal member holding portion due to inflow of foreign matter contained in oil into the seal member holding portion.

Means for Solving the Problem

In order to attain the aforementioned object, a variable oil pump according to an aspect of the present invention includes a pump housing, an oil pump rotor housed in the pump housing and rotationally driven, an adjustment member housed in the pump housing and that adjusts an amount of oil discharged from the oil pump rotor by being displaced under hydraulic pressure supplied to a hydraulic chamber between the pump housing and the oil pump rotor in a state where the oil pump rotor is rotatably held from an outer peripheral side, a seal member provided in a portion where the adjustment member and the pump housing face each other and that seals oil leakage to an outside of the hydraulic chamber, a seal member holding portion provided in the adjustment member and that holds the seal member, and an oil passage provided in the adjustment member and through which the hydraulic pressure in the hydraulic chamber is drawn into the seal member holding portion.

In the variable oil pump according to this aspect of the present invention, as hereinabove described, the adjustment member is provided with the seal member holding portion that holds the seal member and the oil passage through which the hydraulic pressure in the hydraulic chamber is drawn into the seal member holding portion. Thus, even when foreign matter contained in oil flows into the seal member holding portion via the oil passage during operation of the variable oil pump, the foreign matter can escape to the oil passage provided in the adjustment member, and hence the foreign matter can be prevented from being trapped between the seal member holding portion and the seal member. Consequently, it is possible to significantly reduce or prevent impairment of the mobility (slidability) of the seal member held by the seal member holding portion due to the foreign matter contained in the oil and that flows into the seal member holding portion.

In the aforementioned variable oil pump according to this aspect, the oil passage preferably extends in a groove shape from a side of a tip of the seal member that slides with respect to an inner surface of the pump housing toward a root of the seal member held by the seal member holding portion.

According to this structure, a wall of the seal member holding portion other than the groove-like oil passage can separate the outside (hydraulic chamber side) of the seal member holding portion from the inside (the side on which the seal member slides) of the seal member holding portion formed with the oil passage that extends in a groove shape. Therefore, when the oil in the hydraulic chamber is drawn into the seal member holding portion from a gap between the inner surface of the pump housing and a tip (an entrance of the oil passage) of the seal member holding portion, only the oil is allowed to flow through the oil passage, and the foreign matter in the hydraulic chamber can be prevented from flowing through the oil passage as much as possible. Consequently, the foreign matter can be prevented from being trapped between the seal member holding portion and the seal member as much as possible.

In this case, the seal member holding portion preferably includes a foreign matter storage portion formed in a vicinity of a root of the seal member and that stores foreign matter contained in the oil drawn from the hydraulic chamber and that flows through the oil passage.

According to this structure, when the foreign matter in the hydraulic chamber is drawn into the seal member holding portion via the oil passage, the foreign matter can escape to (accumulate in) the foreign matter storage portion formed in the vicinity of the root of the seal member, and hence the foreign matter can be effectively prevented from being trapped between the seal member holding portion and the seal member. Therefore, even when the foreign matter is drawn into the oil passage, the mobility (slidability) of the seal member can be easily maintained.

In the aforementioned structure in which the seal member holding portion includes the foreign matter storage portion, the foreign matter storage portion is preferably formed in the seal member holding portion so as to extend in a thickness direction of the seal member perpendicular to a direction in which the oil passage extends, and a sectional area of the foreign matter storage portion in a direction perpendicular to a direction in which the foreign matter storage portion extends is preferably larger than a sectional area of the oil passage in a direction perpendicular to the direction in which the oil passage extends.

According to this structure, when the foreign matter in the hydraulic chamber is drawn into the seal member holding portion via the oil passage, the foreign matter storage portion (having the sectional area) that is a space larger than the oil passage can easily store the foreign matter. Therefore, even when the foreign matter is drawn into the oil passage, the mobility (slidability) of the seal member can be reliably maintained.

The aforementioned structure in which the seal member holding portion includes the foreign matter storage portion preferably further includes an urging member disposed on the seal member holding portion and that urges the seal member toward an inner surface of the pump housing by pressing the root, and the foreign matter storage portion is preferably provided between the oil passage and the urging member.

According to this structure, when the foreign matter in the hydraulic chamber is drawn into the seal member holding portion via the oil passage, the foreign matter storage portion is provided between the oil passage and the urging member, and hence it is possible to significantly reduce or prevent the foreign matter reaching a position where the urging member is disposed. That is, a state where the urging member does not properly function due to the foreign matter that remains in the vicinity of the urging member and the seal member is not properly pressed against the inner surface of the pump housing can be avoided. Consequently, even when the foreign matter is drawn into the oil passage, the seal member can be properly pressed against the inner surface of the pump housing, and hence the sealing performance (function of preventing oil leakage to the outside of the hydraulic chamber) of the seal member can be kept high.

In this case, the seal member holding portion preferably slidably sandwiches both side surfaces of the seal member, and the foreign matter storage portion is preferably provided in the vicinity of the root corresponding to each of one side surface and the other side surface of the seal member with the urging member as a center.

According to this structure, when the foreign matter in the hydraulic chamber is drawn into the seal member holding portion via the oil passage, the foreign matter can escape to and be stored in at least one of the foreign matter storage portion on the one side surface side provided between the oil passage and the urging member and the foreign matter storage portion disposed on the opposite side (the other side surface side) with reference to the urging member. Therefore, the foreign matter does not remain in the urging member and the vicinity thereof, and hence the sealing performance of the seal member can be reliably maintained.

In the aforementioned variable oil pump in which the seal member holding portion includes the foreign matter storage portion, the foreign matter storage portion preferably passes through the seal member holding portion along a thickness direction of the seal member.

According to this structure, the volume of the foreign matter storage portion can be maximized, and hence even if the foreign matter is gradually accumulated, the foreign matter can be stored in the foreign matter storage portion with a margin. Therefore, the mobility of the vane held by the vane holding portion can be maintained over a long period of time.

In the aforementioned variable oil pump according to this aspect, the oil passage is preferably formed in a region where the seal member holding portion faces the pump housing on each of one side and the other side in a thickness direction of the seal member holding portion.

According to this structure, even when the sectional area of the oil passage is small in order to draw only the oil in the hydraulic chamber, the oil passage is provided on each of one side and the other side in the thickness direction of the vane holding portion, and hence the oil can be sufficiently drawn into the vane holding portion. Furthermore, even if the drawn foreign matter escapes to the oil passage on one side and flow of the oil is almost reduced, the oil can be drawn from the oil passage on the other side, and hence the oil can be reliably drawn into the vane holding portion.

BRIEF DESCRIPTION OF THE DRAWINGS

FIG. 5 A sectional view taken along the line 150-150 in FIG. 4.

FIG. 6 A sectional view taken along the line 160-160 in FIG. 4.

MODES FOR CARRYING OUT THE INVENTION

Embodiments of the present invention are hereinafter described on the basis of the drawings.

First Embodiment

A variable oil pump 100 according to a first embodiment is now described with reference to FIGS. 1 to 8.

(Overall Configuration of Variable Oil Pump)

Figure 1:
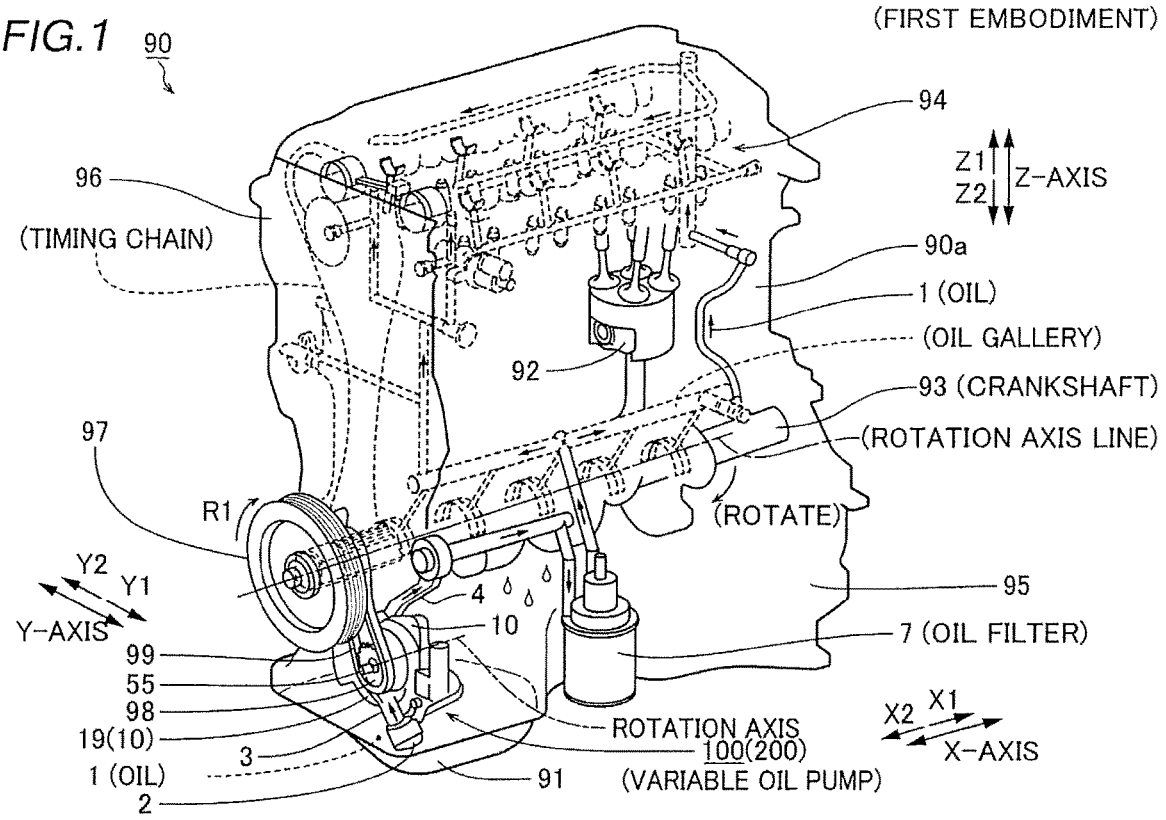
FIG. 1 A diagram showing an engine mounted with a variable oil pump according to a first embodiment of the present invention.

As shown in FIG. 1, the variable oil pump 100 according to the first embodiment of the present invention is mounted on an automobile (not shown) including an engine 90. The variable oil pump 100 has a function of pumping oil (engine oil) 1 in an oil pan 91 to movable portions (sliding portions) such as a plurality of pistons 92, a crankshaft 93, and a valve mechanism 94.

Figure 2:
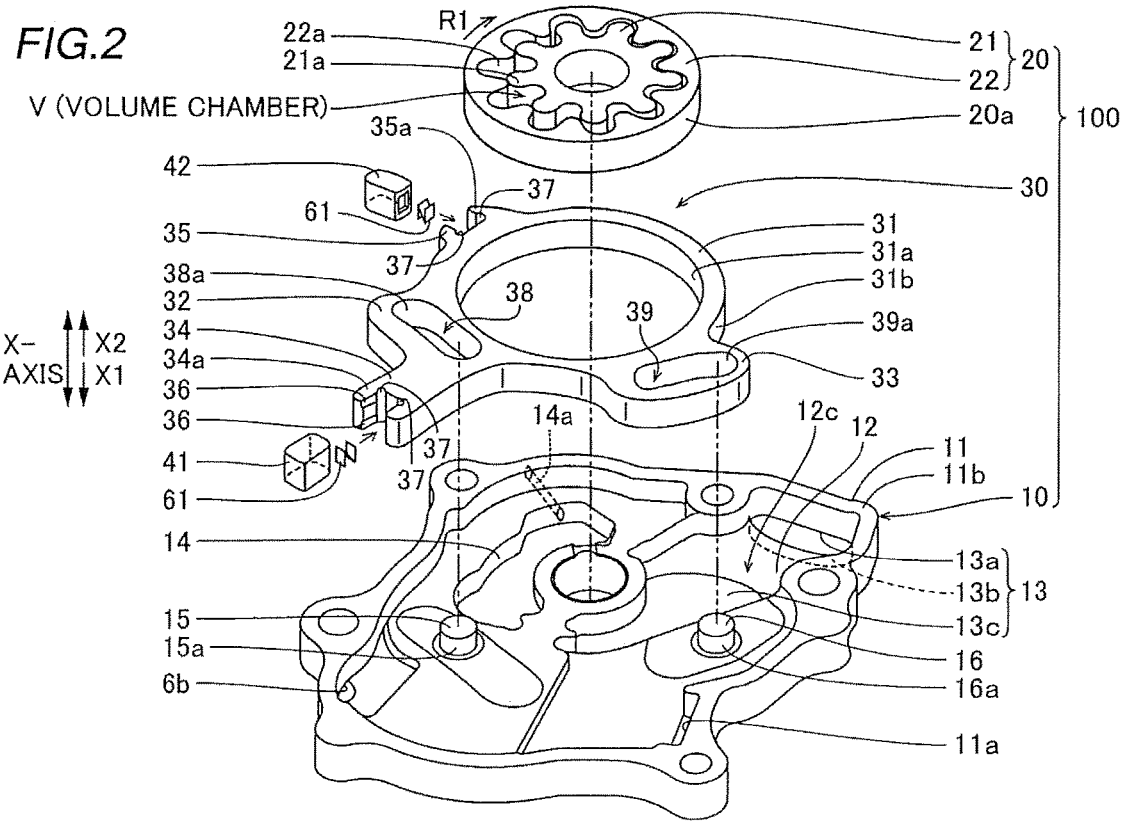
FIG. 2 An exploded perspective view showing the structure of the variable oil pump according to the first embodiment of the present invention.

As shown in FIG. 2, the variable oil pump 100 includes a housing (an example of a pump housing) 10, a pump rotor (an example of an oil pump rotor) 20 rotatably provided in the housing 10, an adjustment ring 30 (an example of an adjustment member) that rotatably holds the pump rotor 20 from the outer peripheral side, a coil spring 60 (see FIG. 3) that urges the adjustment ring 30 toward its initial position, and a cover 19 (see FIG. 1) that covers the housing 10 in an arrow X1 direction from an X2 side. The pump rotor 20 includes an inner rotor 21 of an external gear and an outer rotor 22 of an internal gear.

Figure 3:
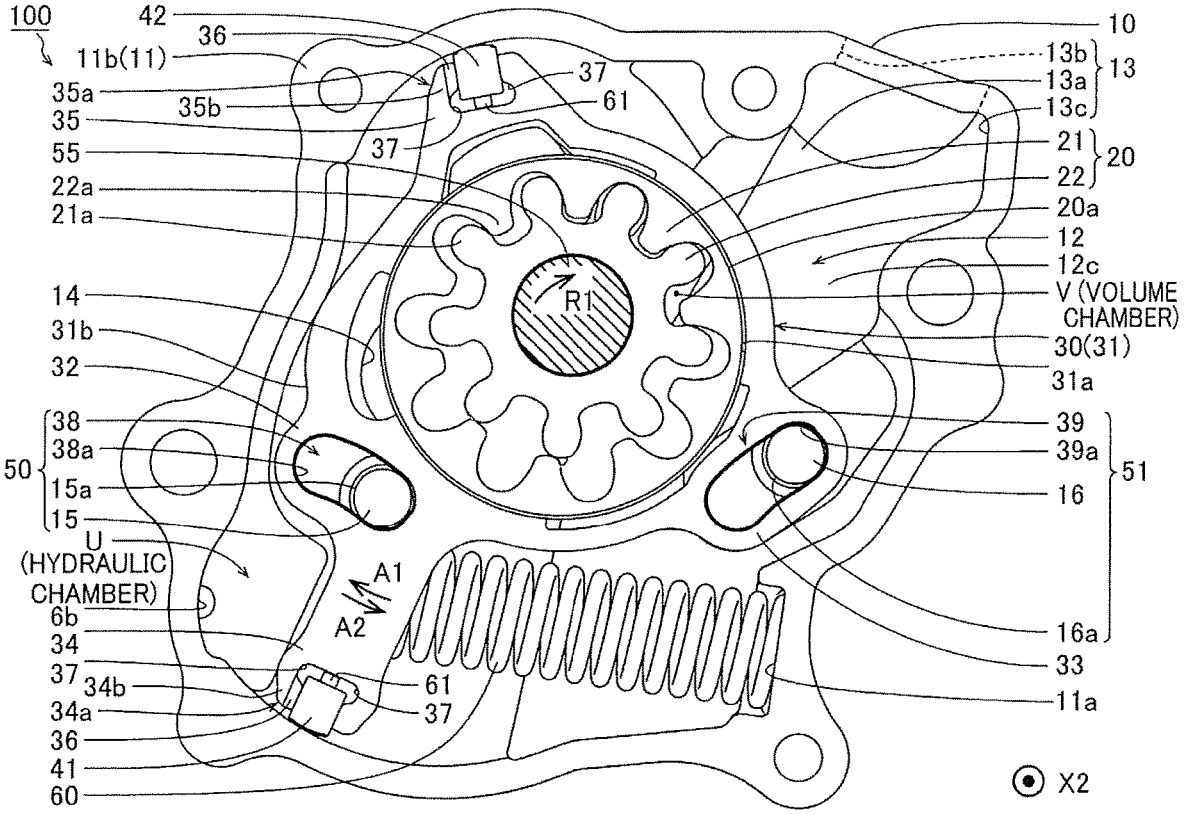
FIG. 3 A plan view showing the internal structure of the variable oil pump according to the first embodiment of the present invention.

As shown in FIG. 3, the rotational center of the inner rotor 21 is decentered by a fixed amount with respect to the rotational center of the outer rotor 22. When the inner rotor 21 rotates in an arrow R1 direction (clockwise direction), the inner rotor 21 rotates with a slight delay in the same direction. At the time of rotation, in a portion where a distance between the inner rotor 21 and the outer rotor 22 is short, external teeth 21*a* of the inner rotor 21 mesh with internal teeth 22*a* of the outer rotor 22. On the other hand, in a portion where the distance is long, the number of the external teeth 21*a* of the inner rotor 21 is one less than the number of the internal teeth 22*a* of the outer rotor 22, and hence a volume chamber V is gradually formed between the inner rotor 21 and the outer rotor 22. Furthermore, the volume chamber V expands and contracts as the pump rotor 20 rotationally moves in the arrow R1 direction such that a pumping function is created in the pump rotor 20.

The external teeth 21*a* of the inner rotor 21 each have a tooth profile in which the tooth width is narrowed and the tooth length is stretched radially outward as compared with external teeth of an inner rotor in a common trochoid pump. The internal teeth 22*a* of the outer rotor 22 match the tooth profile of the external teeth 21*a* to mesh therewith such that a larger volume of the volume chamber V formed in the pump rotor 20 is ensured.

As shown in FIG. 1, the variable oil pump 100 is disposed obliquely downward with respect to the crankshaft 93 inside a crankcase 95. In the engine 90, a vertically long chain cover (timing chain cover) 96 is fastened to a side end surface of an engine block 90*a* on the X2 side, and a region (Z2 side) of a lower end of the chain cover 96 is fastened to a side end surface of the oil pan 91 in the crankcase 95. An end of the crankshaft 93 on the X2 side is exposed to the outside (X2 side) via an oil seal (not shown) fitted into a through-hole of the chain cover 96, and a crank pulley 97 is attached to this portion.

Accordingly, the variable oil pump 100 is disposed inside the chain cover 96, and a timing chain 99 is wound around the crankshaft 93 and a sprocket 98 on the side of an input shaft 55. The drive force of the crankshaft 93 is transmitted to the input shaft 55 via the timing chain 99 and the sprocket 98 both for driving the oil pump, and the pump rotor 20 is rotated by the input shaft 55 pressed into the inner rotor 21.

(Detailed Configuration of Variable Oil Pump)

As shown in FIG. 2, the housing 10 is a concave (deep dish-shaped) casting of an aluminum alloy, and includes a circumferential wall 11 that surrounds the outer edge of the housing 10 and a bottom 12 that connects the wall 11. Furthermore, in a state where the pump rotor 20, the adjustment ring 30, and the coil spring 60 (see FIG. 3) are housed in a concave housing recess 12*c* defined by the wall 11 and the bottom 12 in a predetermined positional relationship, the cover 19 (see FIG. 1) is attached. In addition, the housing 10 is provided with a suction port 13 through which the oil 1 (see FIG. 1) is suctioned and a discharge port 14 through which the oil 1 (see FIG. 1) is discharged.

Whereas the suction port 13 is connected to a pipe 3 (see FIG. 4) connected to an oil strainer 2 via an oil passage 13*b* inside the housing 10 from an opening 13*a* opened in the bottom 12, a downstream portion 13*c* is formed in a shallow groove shape by recessing the bottom 12 according to a suction range. The discharge port 14 is formed in a shallow groove shape by recessing the bottom 12 according to a discharge range, and is connected to a discharge oil passage 4 (see FIG. 4) via an oil passage 14*a* inside the housing 10.

The housing 10 includes two pins 15 and 16 that protrude in an X-axis direction from the bottom 12. The pins 15 and 16 include outer surfaces 15*a* and 16*a* circularly formed. The pins 15 and 16 are configured to engage with guide holes 38 and 39 of the adjustment ring 30 described later, respectively. In addition, the cover 19 (see FIG. 1) is fastened to a joint surface 11*b* (an end surface on the X2 side) of the wall 11 of the housing 10 in the arrow X1 direction from the X2 side in FIG. 2 by a fastening member (not shown).

The variable oil pump 100 includes a variable displacement mechanism to change the discharge amount (pump capacity) of the oil 1 discharged every rotation of the pump rotor 20. This variable displacement mechanism is a mechanism that displaces (rotates) the adjustment ring 30 due to hydraulic pressure (control hydraulic pressure) in a hydraulic chamber U formed in the housing recess 12*c* of the housing 10. The relative positions of the inner rotor 21 and the outer rotor 22 with respect to the suction port 13 and the discharge port 14 are changed due to the displacement (rotation) of the adjustment ring 30, and the pump capacity is changed. The variable displacement mechanism including the adjustment ring 30 is described below in detail.

(Configuration of Variable Displacement Mechanism)

As shown in FIG. 2, the adjustment ring 30 includes a main body 31, overhangs 32 and 33, an operation portion 34, and a protrusion 35. The overhangs 32 and 33, the operation portion 34, and the protrusion 35 are integral with the main body 31. The pump rotor 20 is disposed such that its outer peripheral surface 20*a* smoothly contacts (slides with respect to) the inner peripheral surface 31*a* of the main body 31.

The main body 31 is annular, and has a function of rotatably holding the pump rotor 20 (outer rotor 22) from the outer peripheral side. The outer surface 31*b* of the main body 31 overhangs outward (in an outward radial direction of rotation) such that the overhangs 32 and 33 are formed. The overhang 32 is formed with the elongated hole-shaped guide hole 38 that penetrates in a thickness direction (X-axis direction), and the overhang 33 is formed with the elongated hole-shaped guide hole 39 that penetrates in the thickness direction.

The operation portion 34 protrudes from the outer surface 31*b*, and an external force (the hydraulic pressure in the hydraulic chamber U or the urging force of the coil spring 60) is applied thereto when the main body 31 rotates. A vane holding portion 34*a* (an example of a seal member holding portion), which includes a concavely recessed tip, of the operation portion 34 holds a vane 41 (an example of a seal member) via a leaf spring 61 (an example of an urging member). The protrusion 35 protrudes from the outer surface 31*b*, and a vane holding portion 35*a* (an example of a seal member holding portion) including a concavely recessed tip holds a vane 42 (an example of a seal member) via a leaf spring 61. The vanes 41 and 42 have substantially the same length as the thickness (a dimension in the X-axis direction) of the adjustment ring 30, and are made of a resin material or the like excellent in wear resistance.

According to the first embodiment, as shown in FIG. 3, the vane holding portion 34*a* is provided with oil passages 36 through which the hydraulic pressure in the hydraulic chamber U is drawn into the vane holding portion 34*a*. Similarly, the vane holding portion 35*a* is also provided with oil passages 36 through which the hydraulic pressure in the hydraulic chamber U is drawn into the vane holding portion 35*a*. The vane holding portions 34*a* and 35*a* each provided with the oil passages 36 basically have the same configuration and function, and hence the vane holding portion 34*a* continues to be described as a representative.

Figure 4:
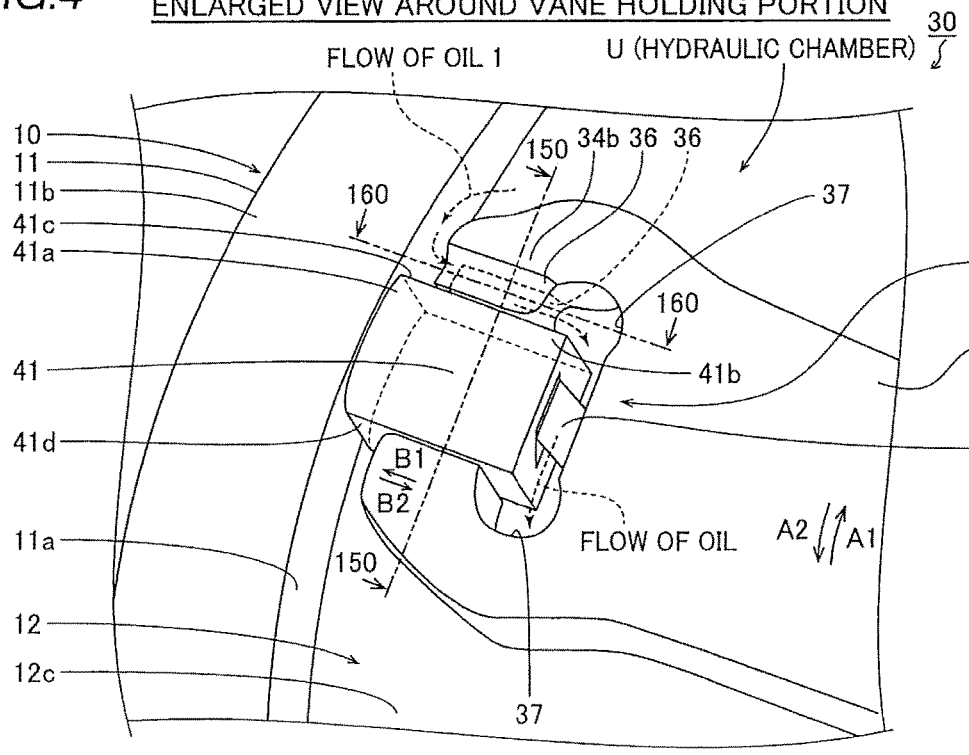
FIG. 4 An enlarged perspective view around a vane holding portion of the variable oil pump according to the first embodiment of the present invention.

As shown in FIG. 4, the oil passages 36 each extend linearly and in a groove shape from the side of a tip 41*a* of the vane 41 that slides with respect to the inner surface 11*a* of the housing 10 toward a root 41*b* of the vane 41 held by the vane holding portion 34*a*. Therefore, the vane holding portion 34*a* is provided with a wall 34*b* other than the oil passages 36. That is, the wall 34*b* separates the outside (the hydraulic chamber U side) of the vane holding portion 34*a* from the inside (the side on which the vane 41 slides) of the vane holding portion 34*a* where the oil passages 36 that extend in a groove shape are formed. Furthermore, as shown in FIGS. 5 and 6, the oil passages 36 are provided in regions 10*a* and 10*b* where the vane holding portion 34*a* faces the housing 10 on one side (X1 side) and the other side (X2 side) in the thickness direction (X-axis direction) of the vane holding portion 34*a*, respectively. The vane holding portion 35*a* also has a wall 35*b*.

As shown in FIG. 4, the vane holding portion 34*a* is further provided with foreign matter storage portions 37 that store foreign matter contained in the oil 1 that flows through the oil passages 36 in addition to the oil passages 36. As shown in FIGS. 4 and 6, the foreign matter storage portions 37 are formed in the vane holding portion 34*a* so as to extend in the thickness direction (X-axis direction) of the vane 41 perpendicular to an arrow B2 direction in which the oil passages 36 extend. Furthermore, the foreign matter storage portions 37 pass through the vane holding portion 34*a* in the thickness direction (X-axis direction). The sectional area S2 (see FIG. 6) of each of the foreign matter storage portions 37 in a Y-Z plane in a direction perpendicular to the X-axis direction in which the foreign matter storage portions 37 extend is larger than the sectional area S1 (a sectional area in a direction along the plane of FIG. 5) of each of the oil passages 36 in a direction perpendicular to the arrow B2 direction in which the oil passages 36 extend.

As shown in FIG. 4, one of the foreign matter storage portions 37 is provided between the oil passages 36 and the leaf spring 61. Furthermore, the foreign matter storage portions 37 are provided in the vicinity of the root 41*b* corresponding to one side surface 41*c* and the other side surface 41*d* of the vane 41 with the leaf spring 61 as a center, respectively. A structure similar to that of the vane holding portion 34*a* is also provided in the vane holding portion 35*a*. However, in the vane holding portion 35*a*, a position where the oil passages 36 are formed is located on the side (the side closer to the hydraulic chamber U) opposite to that of the vane holding portion 34*a*. The oil passages 36 of the vane holding portion 35*a* extend along the other side surface 42*d* of the vane 42 on the side that faces the hydraulic chamber U. A pair of foreign matter storage portions 37 are provided in the vicinity of a root 42*b* corresponding to one side surface 42*c* and the other side surface 42*d* with the leaf spring 61 as a center.

Figure 7:
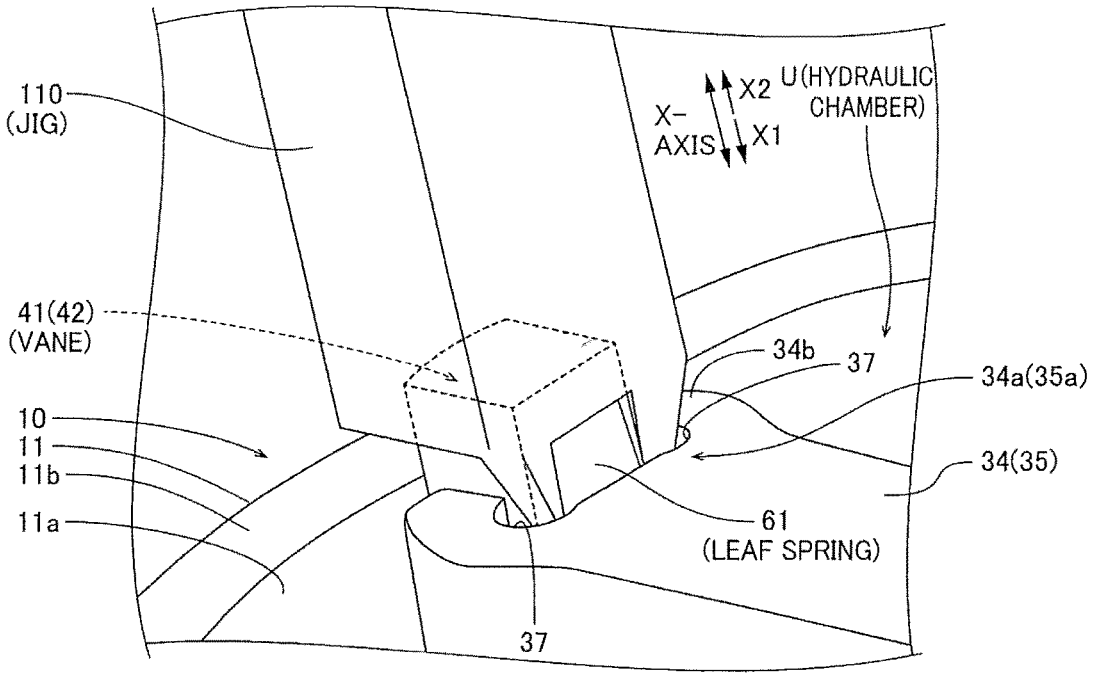
FIG. 7 A diagram showing part of an assembly process of the variable oil pump according to the first embodiment of the present invention.

According to the first embodiment, as shown in FIG. 7, when the vane 41 (42) and the leaf spring 61 are assembled to the vane holding portion 34*a* (35*a*), a convex portion 151 formed on a jig 110 is inserted into the foreign matter storage portions 37 in a state where the vane 41 (42) and the leaf spring 61 are held by the jig 110 such that the vane 41 (42) and the leaf spring 61 are attached to the vane holding portion 34*a* (35*a*) using the foreign matter storage portions 37 as a reference for assembly.

As shown in FIG. 3, the coil spring 60 is fitted into a region where the inner surface 11*a* of the wall 11 faces the operation portion 34 in a state where the adjustment ring 30 is housed in the housing 10. The operation portion 34 is urged in an arrow A1 direction due to the extension force of the coil spring 60. That is, due to the pressing force of the coil spring 60 that acts on the operation portion 34, the adjustment ring 30 is urged so as to be rotated (displaced) in the clockwise direction in FIG. 1 about the input shaft 55. Thus, when the hydraulic pressure does not act on the operation portion 34, the adjustment ring 30 is held at the initial position where the adjustment ring 30 starts to be displaced (rotate) in a state where the coil spring 60 is maximally extended.

In a state where the adjustment ring 30 is housed in the housing 10, the hydraulic chamber U is formed in a region surrounded by the inner surface 11*a* of the wall 11, the vanes 41 and 42, and the outer surface 31*b* (including a portion of the outer surface of the operation portion 34) of the adjustment ring 30 between the vanes 41 and 42. In a state where the adjustment ring 30 is housed in the housing 10, the pin 15 is slidably inserted into the guide hole 38 and engages therewith, and the pin 16 is slidably inserted into the guide hole 39 and engages therewith. The pin 15 and the guide hole 38 engage with each other, and the pin 16 and the guide hole 39 engage with each other such that guide portions 51 and 52 guide relative displacement (rotation) of the adjustment ring 30 with respect to the housing 10. In other words, the guide portions 51 and 52 restrict a direction in which the adjustment ring 30 rotates to a direction in which the guide holes 38 and 39 extend (the longitudinal direction of the cross-sections of the guide holes 38 and 39).

Figure 8:
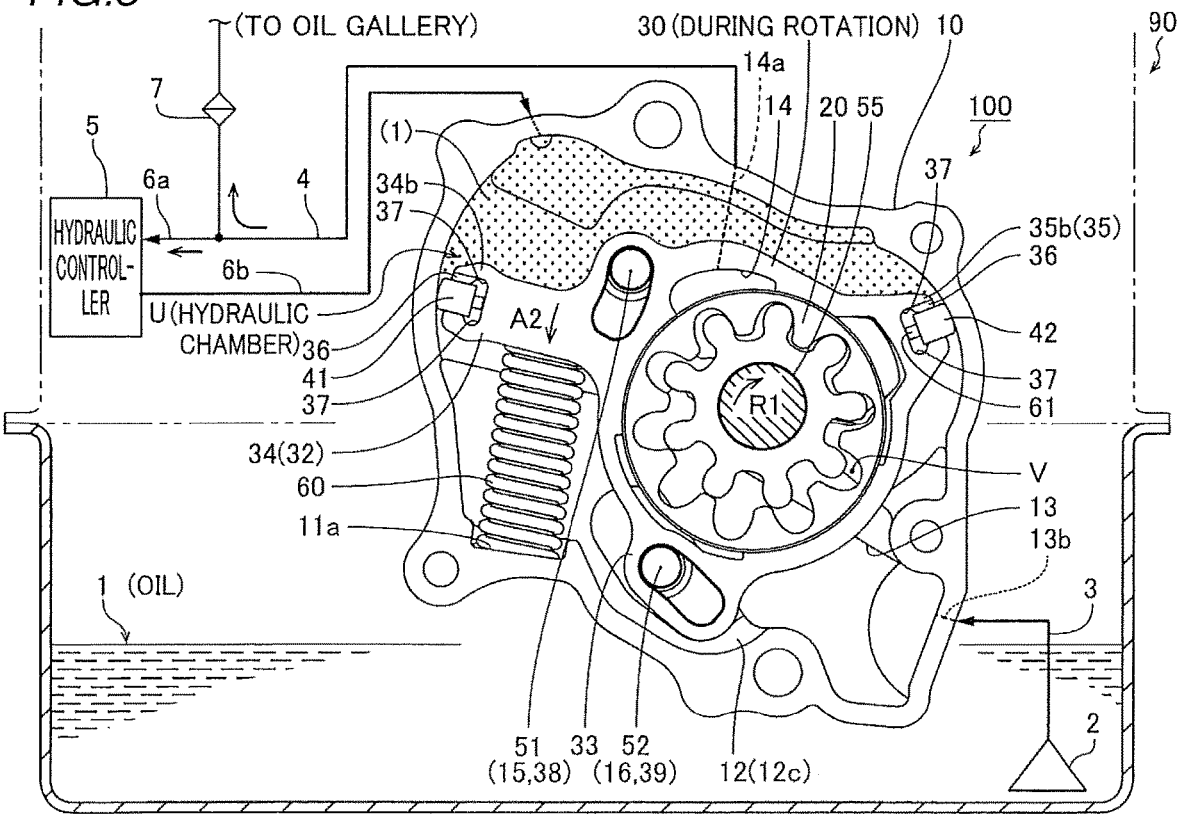
FIG. 8 A diagram showing the capacity control state of the variable oil pump according to the first embodiment of the present invention.

As shown in FIG. 8, a hydraulic controller 5 that allows the variable displacement mechanism of the variable oil pump 100 to operate is provided in the discharge oil passage 4 of the engine 90. Specifically, the variable oil pump 100 and the hydraulic controller 5 are connected to each other by an oil passage 6*a* that branches from the discharge oil passage 4. The hydraulic controller 5 and the hydraulic chamber U in the housing 10 are connected to each other via an oil passage 6*b*. During operation of the variable oil pump 100, the hydraulic controller 5 operates based on a control signal from an ECU (not shown) mounted on the engine 90 such that the oil 1 delivered from the discharge oil passage 4 to the engine 90 (oil gallery) via an oil filter 7 (see FIG. 1) is partially drawn into the hydraulic controller 5 via the oil passage 6*a*, and then supplied to the hydraulic chamber U via the oil passage 6*b*.

Variable displacement control of the amount of the oil 1 discharged by the variable oil pump 100 is now described with reference to FIGS. 3 and 8.

(Description of Variable Displacement Control)

First, as shown in FIG. 3, the pump rotor 20 is driven in the arrow R1 direction by the input shaft 55 that rotates together with the start-up of the engine 90. At this time, the hydraulic controller 5 does not operate, and the adjustment ring 30 is held at the initial position reached when the adjustment ring 30 is maximally rotated in the arrow A1 direction due to the urging force of the coil spring 60. At the initial position, the inner surface 38*a* (39*a*) of the guide hole 38 (39) and the outer surface 15*a* (16*a*) of the pin 15 (16) contact each other. At the initial position, the suction port 13 faces a negative pressure action region where the pressure of the oil 1 is reduced between the external teeth 21*a* of the inner rotor 21 and the internal teeth 22*a* of the outer rotor 22, and the discharge port 14 faces a positive pressure action region where the oil 1 is compressed between the external teeth 21*a* of the inner rotor 21 and the internal teeth 22*a* of the outer rotor 22. Therefore, the oil 1 is suctioned into the pump rotor 20 from the suction port 13 and is discharged from the discharge port 14 to the discharge oil passage 4 via the oil passage 14*a*.

Then, as shown in FIG. 8, the hydraulic controller 5 operates based on the control signal from the ECU (not shown) according to the rotational speed and load of the engine 90. That is, after the oil 1 from the suction port 13 is drawn into the hydraulic controller 5 via the oil passage 6*a*, the oil 1 is supplied to the hydraulic chamber U via the oil passage 6*b*. Then, the hydraulic pressure of the oil 1 supplied to the hydraulic chamber U acts on the operation portion 34 of the adjustment ring 30 such that the adjustment ring 30 starts to rotate in an arrow A2 direction against the urging force of the coil spring 60.

Together with the rotation of the adjustment ring 30 in the arrow A2 direction, the outer rotor 22 of the pump rotor 20 revolves in the arrow A2 direction while maintaining a predetermined amount of eccentricity with respect to the rotational center of the inner rotor 21 in a state where the internal teeth 22*a* mesh with the external teeth 21*a* of the inner rotor 21. Thus, the positive pressure action region and the negative pressure action region are moved about the rotational center of the inner rotor 21, and hence the negative pressure that acts on the suction port 13 from the negative pressure action region is reduced, and the positive pressure that acts on the discharge port 14 from the positive pressure action region is also reduced. Consequently, the amount (a supply to the engine 90) of the oil 1 discharged from the pump rotor 20 is reduced.

The ECU controls the operation of the hydraulic controller 5 in detail such that the hydraulic pressure (the urging force for urging the operation portion 34 in the arrow A2 direction) of the oil 1 supplied to the hydraulic chamber U is adjusted. Thus, the rotational position of the adjustment ring 30 is precisely adjusted according to the balance relationship between the hydraulic pressure in the hydraulic chamber U with respect to the operation portion 34 and the urging force (the urging force for urging the operation portion 34 in the arrow A1 direction) of the coil spring 60 with respect to the operation portion 34. In addition, the rotational position of the adjustment ring 30 is adjusted such that the amount of the oil 1 discharged by the variable oil pump 100 is controlled in detail. The variable oil pump 100 according to the first embodiment is configured as described above.

Effects of First Embodiment

According to the first embodiment, the following effects can be obtained.

According to the first embodiment, as hereinabove described, the adjustment ring 30 is provided with the vane holding portion 34*a* (35*a*) that holds the vane 41 (42) and the oil passages 36 through which the hydraulic pressure in the hydraulic chamber U is drawn into the vane holding portion 34*a* (35*a*). Thus, even when the foreign matter contained in the oil 1 flows into the vane holding portion 34*a* (35*a*) via the oil passages 36 during operation of the variable oil pump 100, the foreign matter can escape to the oil passages 36 provided in the adjustment ring 30, and hence the foreign matter can be prevented from being trapped between the vane holding portion 34*a* (35*a*) and the vane 41 (42). Consequently, it is possible to significantly reduce or prevent impairment of the mobility (smooth slidability) of the vane 41 (42) held by the vane holding portion 34*a* (35*a*) due to the foreign matter contained in the oil 1 and that flows into the vane holding portion 34*a* (35*a*)).

According to the first embodiment, the oil passages 36 each extend in a groove shape from the side of the tip 41*a* (42*a*) of the vane 41 (42) that slides with respect to the inner surface 11*a* of the housing 10 toward the root 41*b* (42*b*) held by the vane holding portion 34*a* (35*a*). Thus, the wall 34*b* (35*b*) of the vane holding portion 34*a* (35*a*) other than the groove-like oil passages 36 can separate the outside (hydraulic chamber U side) of the vane holding portion 34*a* (35*a*) from the inside (the side on which the vane 41 (42) slides) of the vane holding portion 34*a* (35*a*) formed with the oil passages 36 that extend in a groove shape. Therefore, when the oil 1 in the hydraulic chamber U is drawn into the vane holding portion 34*a* (35*a*) from a gap between the inner surface 11*a* of the housing 10 and the tip (entrances of the oil passages 36) of the vane holding portion 34*a* (35*a*), only the oil 1 is allowed to flow through the oil passages 36, and the foreign matter in the hydraulic chamber U can be prevented from flowing through the oil passages 36 as much as possible. Consequently, the foreign matter can be prevented from being trapped between the vane holding portion 34*a* (35*a*) and the vane 41 (42) as much as possible.

According to the first embodiment, the foreign matter storage portions 37 formed in the vicinity of the root 41*b* (42*b*) of the vane 41 (42) and that store the foreign matter contained in the oil 1 drawn from the hydraulic chamber U and that flows through the oil passages 36 are provided in the vane holding portion 34*a* (35*a*). Thus, when the foreign matter in the hydraulic chamber U is drawn into the vane holding portion 34*a* (35*a*) via the oil passages, the foreign matter can escape to (accumulate in) the foreign matter storage portions 37 formed in the vicinity of the root 41*b* (42*b*) of the vane 41 (42), and hence the foreign matter can be effectively prevented from being trapped between the vane holding portion 34*a* (35*a*) and the vane 41 (42). Therefore, even when the foreign matter is drawn into the oil passages 36, the mobility (smooth slidability) of the vane 41 (42) can be easily maintained.

According to the first embodiment, the foreign matter storage portions 37 are formed in the vane holding portion 34*a* (35*a*) so as to extend in the thickness direction (X-axis direction) of the vane 41 (42) perpendicular to the arrow B2 direction in which the oil passages 36 extend. Furthermore, the sectional area S1 of each of the foreign matter storage portions 37 in the Y-Z plane is larger than the sectional area S2 (the sectional area in the direction along the plane of FIG. 5) of each of the oil passages 36. Thus, when the foreign matter in the hydraulic chamber U is drawn into the vane holding portion 34*a* (35*a*) via the oil passages 36, each of the foreign matter storage portions 37 having the sectional area S2, which is a space larger than each of the oil passages 36, can easily store the foreign matter. Therefore, even when the foreign matter is drawn into the oil passages 36, the mobility (smooth slidability) of the vane 41 (42) can be reliably maintained.

According to the first embodiment, one of the foreign matter storage portions 37 is provided between the oil passages 36 and the leaf spring 61. Thus, when the foreign matter in the hydraulic chamber U is drawn into the vane holding portion 34*a* (35*a*) via the oil passages 36, the foreign matter storage portion 37 exists between the oil passages 36 and the leaf spring 61, and hence it is possible to significantly reduce or prevent the foreign matter reaching a position where the leaf spring 61 is disposed. That is, a state where the leaf spring 61 does not properly function due to the foreign matter that remains in the vicinity of the leaf spring 61 and the vane 41 (42) is not properly pressed against the inner surface 11*a* of the housing 10 can be avoided. Consequently, even when the foreign matter is drawn into the oil passages 36, the vane 41 (42) can be properly pressed against the inner surface 11*a* of the housing 10, and hence the sealing performance (function of preventing oil leakage to the outside of the hydraulic chamber U) of the vane 41 (42) can be kept high.

According to the first embodiment, the foreign matter storage portions 37 are provided in the vicinity of the root 41*b* (42*b*) corresponding to one side surface 41*c* (42*c*) and the other side surface 41*d* (42*d*) of the vane 41 (42) with the leaf spring 61 as a center, respectively. Thus, when the foreign matter in the hydraulic chamber U is drawn into the vane holding portion 34*a* (35*a*) via the oil passages 36, the foreign matter can escape to and be stored in at least one of the foreign matter storage portion 37 on the one side surface 41*c* (42*c*) side provided between the oil passages 36 and the leaf spring 61 and the foreign matter storage portion 37 disposed on the opposite side (the other side surface 41*d* (42*d*) side) with reference to the leaf spring 61. Therefore, the foreign matter does not remain in the leaf spring 61 and the vicinity thereof, and hence the sealing performance of the vane 41 (42) can be reliably maintained.

According to the first embodiment, the oil passages 36 are formed in the regions 10*a* and 10*b* where the vane holding portion 34*a* (35*a*) faces the housing 10 on one side and the other side in the thickness direction of the vane holding portion 34*a* (35*a*), respectively. Thus, even when the sectional area S1 of each of the oil passages 36 is small in order to draw only the oil 1 in the hydraulic chamber U, the oil passages 36 are provided on one side and the other side in the thickness direction of the vane holding portion 34*a* (35*a*), respectively, and hence the oil 1 can be sufficiently drawn into the vane holding portion 34*a* (35*a*). Furthermore, even if the drawn foreign matter escapes to the oil passage 36 on one side and flow of the oil 1 is almost reduced, the oil 1 can be drawn from the oil passage 36 on the other side, and hence the oil 1 can be reliably drawn into the vane holding portion 34*a* (35*a*).

According to the first embodiment, the foreign matter storage portions 37 pass through the vane holding portion 34*a* (35*a*) along the thickness direction of the vane 41 (42). Thus, the volume of the foreign matter storage portions 37 can be maximized, and hence even if the foreign matter is gradually accumulated, the foreign matter can be stored in the foreign matter storage portions 37 with a margin. Therefore, the mobility of the vane 41 (42) held by the vane holding portion 34*a* (35*a*) can be maintained over a long period of time.

According to the first embodiment, when the vane 41 (42) and the leaf spring 61 are assembled to the vane holding portion 34*a* (35*a*), the convex portion 151 formed on the jig 110 is inserted into the foreign matter storage portions 37 in a state where the vane 41 (42) and the leaf spring 61 are held by the jig 110 such that the vane 41 (42) and the leaf spring 61 are assembled to the vane holding portion 34*a* (35*a*) using the foreign matter storage portions 37 as a reference for assembly. Thus, in the course of manufacturing the variable oil pump 100, the vane 41 (42) and the leaf spring 61 held by the jig 110 can be easily attached to the vane holding portion 34*a* (35*a*) by effectively using the foreign matter storage portions 37 formed in advance in the vane holding portion 34*a* (35*a*).

Modification of First Embodiment

A modification of the first embodiment is now described with reference to FIGS. 3 and 9. In this modification of the first embodiment, an example in which one foreign matter storage portion 37 is provided between oil passages 36 and a leaf spring 61 is described. In the figures, configurations similar to those according to the aforementioned first embodiment are denoted by the same reference numerals.

Figure 9:
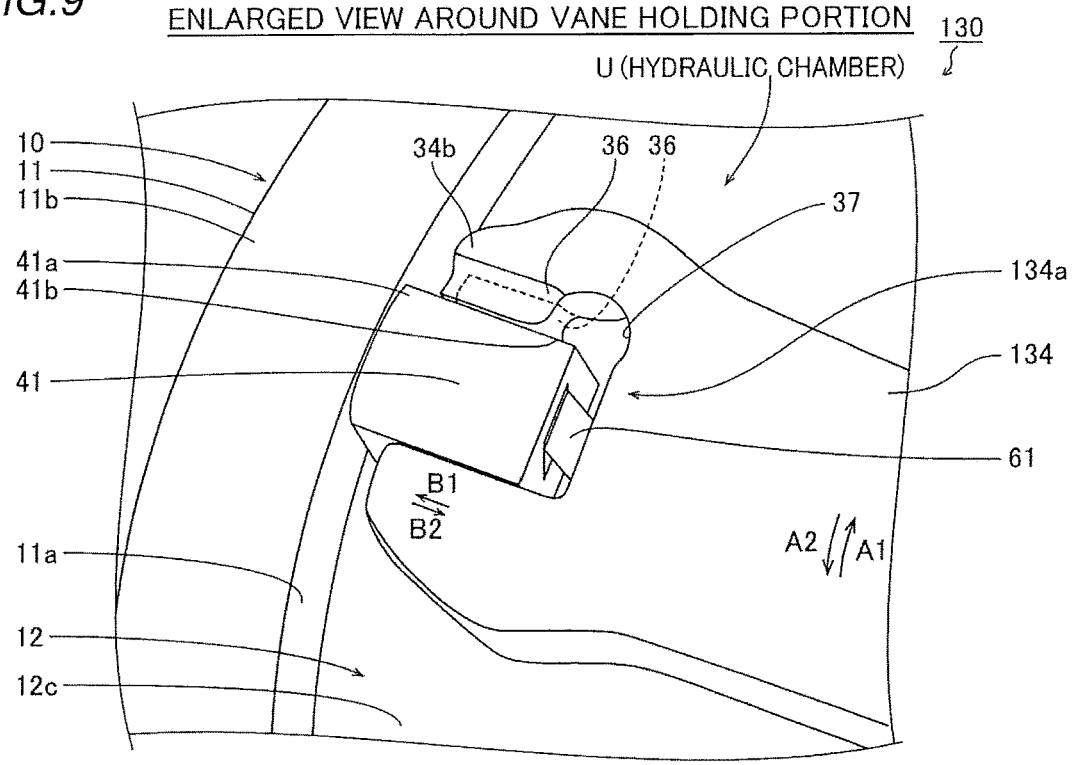
FIG. 9 An enlarged perspective view around a vane holding portion according to a modification of the first embodiment of the present invention.

That is, as shown in FIG. 9, an adjustment ring 130 includes an operation portion 134 including a vane holding portion 134*a* (an example of a seal member holding portion). The vane holding portion 134*a* is provided with the oil passages 36 through which hydraulic pressure in a hydraulic chamber U is drawn into the vane holding portion 134*a*. One foreign matter storage portion 37 is formed between the oil passages 36 and the leaf spring 61 that presses a vane 41. On the other hand, no foreign matter storage portion 37 is provided in the vicinity of a root 41*b* beyond the leaf spring 61 in an arrow A2 direction. Although not shown in the figures, a structure similar to that of the vane holding portion 134*a* is also applied to a vane holding portion 35*a* (see FIG. 3) corresponding to the aforementioned first embodiment.

Effect of Modification of First Embodiment

According to the modification of the first embodiment, the adjustment ring 130 is provided with the vane holding portion 134*a* that holds the vane 41 and the oil passages 36 through which the hydraulic pressure in the hydraulic chamber U is drawn into the vane holding portion 134*a*. Furthermore, one foreign matter storage portion 37 is provided only between the oil passages 36 and the leaf spring 61. As described above, even when the foreign matter storage portion 37 is provided at one location, foreign matter can escape to the oil passages 36 and the foreign matter storage portion 37, and hence the foreign matter can be prevented from being trapped between the vane holding portion 134*a* and the vane 41. Thus, it is possible to significantly reduce or prevent impairment of the mobility (slidability) of the vane 41 with respect to the vane holding portion 134*a*.

Second Embodiment

A second embodiment is now described with reference to FIGS. 1, 3, 4, 10, and 11. In this second embodiment, an example in which the shape of oil passages 81 of a variable oil pump 200 is different from that according to the first embodiment is described.

Figure 10:
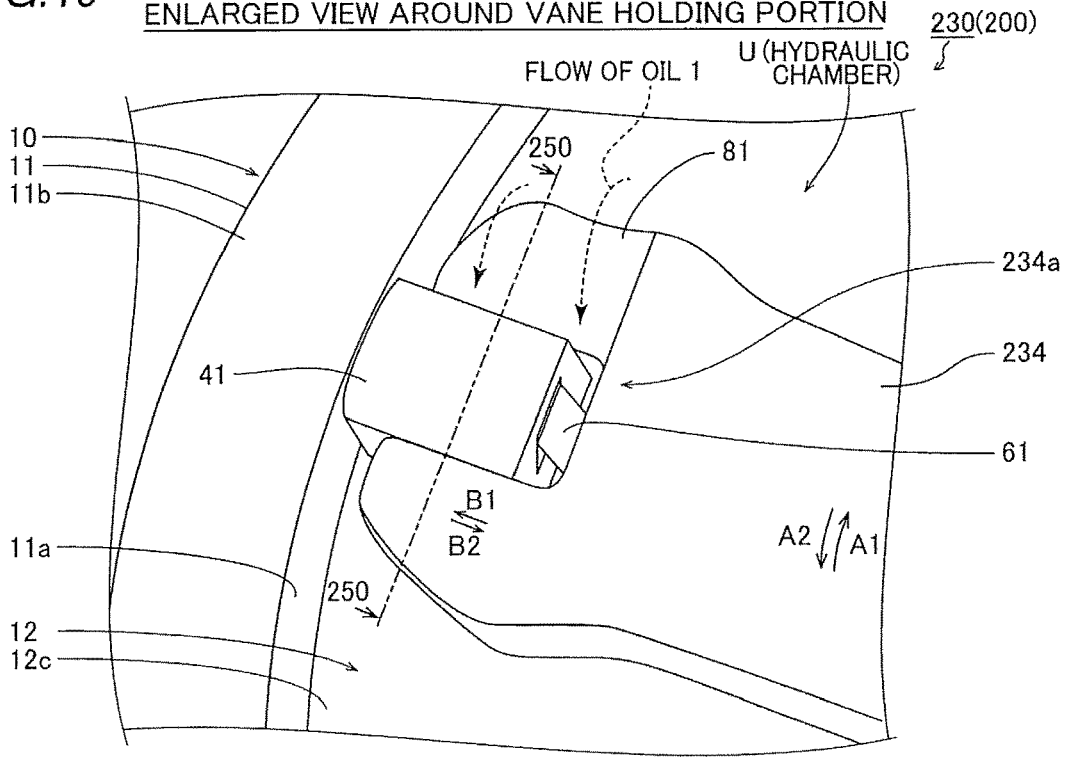
FIG. 10 An enlarged perspective view around a vane holding portion of a variable oil pump according to a second embodiment of the present invention.

As shown in FIG. 10, an adjustment ring 230 incorporated in the variable oil pump 200 (see FIG. 1) includes an operation portion 234 including a vane holding portion 234*a* (an example of a seal member holding portion). The vane holding portion 234*a* is provided with the oil passages 81 through which hydraulic pressure in a hydraulic chamber U is drawn into the vane holding portion 234*a*.

Figure 11:
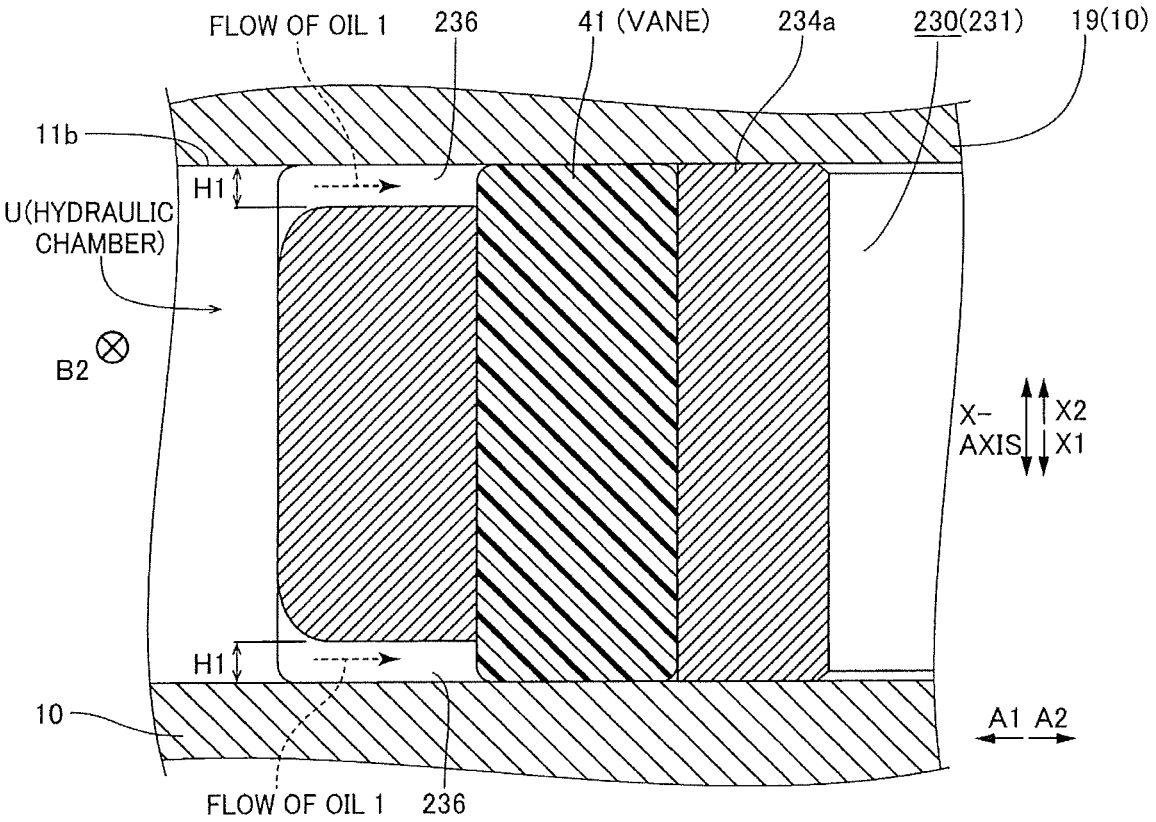
FIG. 11 A sectional view taken along the line 250-250 in FIG. 10.

As shown in FIGS. 10 and 11, unlike the oil passages 36 (see FIG. 4) according to the aforementioned first embodiment, the oil passages 81 are formed by cutting tip regions of the vane holding portion 234*a* on one side (A1 side) so as to spread flat. Furthermore, as shown in FIG. 11, the oil passages 81 are provided in regions 10*a* and 10*b* where the vane holding portion 234*a* faces a housing 10 on one side (X1 side) and the other side (X2 side) in the thickness direction (X-axis direction) of the vane holding portion 234*a*, respectively. In this case, the oil passages 81 are recessed with a depth H1 with respect to the regions 10*a* and 10*b*. In addition, no foreign matter storage portions 37 (see FIG. 4) according to the aforementioned first embodiment are provided in the vane holding portion 234*a*. According to the second embodiment, although not shown in the figures, a structure similar to that of the vane holding portion 234*a* is also applied to a vane holding portion 35*a* (see FIG. 3) corresponding to the aforementioned first embodiment. The remaining configurations and operations of the variable oil pump 200 according to the second embodiment are similar to those according to the aforementioned first embodiment.

Effect of Second Embodiment

According to the second embodiment, the adjustment ring 230 is provided with the vane holding portion 234*a* that holds a vane 41 and the oil passages 81 through which the hydraulic pressure in the hydraulic chamber U is drawn into the vane holding portion 234*a*. Thus, even when foreign matter contained in oil 1 flows into the vane holding portion 234*a* via the oil passages 81 during operation of the variable oil pump 200, the foreign matter can escape to the oil passages 81 provided in the adjustment ring 230, and hence the foreign matter can be prevented from being trapped between the vane holding portion 234*a* and the vane 41. Consequently, it is possible to significantly reduce or prevent impairment of the mobility (smooth slidability) of the vane 41 held by the vane holding portion 234*a*.

Modifications

The embodiments disclosed this time must be considered as illustrative in all points and not restrictive. The range of the present invention is shown not by the above description of the embodiments but by the scope of claims for patent, and all modifications within the meaning and range equivalent to the scope of claims for patent are further included.

For example, while the oil passages 36 (81) are provided in the regions 10*a* and 10*b* where the vane holding portion 34*a* (234*a*) faces the housing 10 on one side (X1 side) and the other side (X2 side) in the thickness direction (X-axis direction) of the vane holding portion 34*a* (234*a*), respectively, in each of the aforementioned first and second embodiments, the present invention is not restricted to this. That is, an oil passage 36 (81) may be provided only in the region 10*a* or 10*b* on one side or the other side (X1 side or X2 side) of the vane holding portion 34*a*.

While the oil passages 36 (81) are exposed in the regions 10*a* and 10*b* where the vane holding portion 34*a* (234*a*) faces the housing 10 in the thickness direction of the vane holding portion 34*a* (234*a*) in each of the aforementioned first and second embodiments, the present invention is not restricted to this. For example, one oil passage 36 may pass through the member from the tip side of the vane holding portion 34*a* toward the foreign matter storage portion 37.

While the foreign matter storage portions 37 pass through the vane holding portion 34*a* (234*a*) in the thickness direction (X-axis direction) in each of the aforementioned first and second embodiments, the present invention is not restricted to this. For example, when an oil passage 36 is provided on one side in the X-axis direction of the vane holding portion 34*a*, a deep hole-like foreign matter storage portion connected to the oil passage 36 and including a bottom that does not break through the other side of the vane holding portion 34*a* in the X-axis direction may be provided.

While only the oil passages 81 are provided in the vane holding portion 234*a* in the aforementioned second embodiment, the present invention is not restricted to this. That is, in addition to the oil passages 81, foreign matter storage portions 37 (see FIG. 4) may be further provided in the vicinity of a root 41*b* (42*b*) of the vane 41 (42).

While the sectional area S1 of each of the foreign matter storage portions 37 is larger than the sectional area S2 of each of the oil passages 36 in each of the aforementioned first embodiment and the modification thereof, the present invention is not restricted to this. That is, the sectional area S1 of each of the foreign matter storage portions 37 and the sectional area S2 of each of the oil passages 36 may be equal to each other.

While the present invention is applied to the variable oil pump 100 that supplies the oil 1 to the engine 90 in each of the aforementioned first and second embodiments, the present invention is not restricted to this. For example, the present invention may be applied to an oil pump that supplies AT fluid to an automatic transmission (AT) that automatically switches a transmission gear ratio according to the rotational speed of an engine. Alternatively, the present invention may be applied to an oil pump that supplies lubricating oil to a sliding portion in a continuously variable transmission (CVT) that continuously and steplessly changes a transmission gear ratio unlike the AT (multistage transmission), or an oil pump that supplies power steering oil to a power steering that drives a steering.

While the variable oil pump 100 is mounted on the automobile including the engine 90 in each of the aforementioned first and second embodiments, the present invention is not restricted to this. The present invention may be applied to a variable oil pump for an internal combustion engine mounted on equipment other than a vehicle. As the internal combustion engine, a gasoline engine, a diesel engine, a gas engine, etc. can be applied.

While the pump rotor 20 having a tooth profile in which the tooth width is narrowed and the tooth length is stretched radially outward as compared with external teeth of an inner rotor and internal teeth of an outer rotor in a common trochoid pump is applied in each of the aforementioned first and second embodiments, the present invention is not restricted to this. That is, the present invention may be applied to a variable oil pump including an internal gear pump rotor in which the tooth profile of each of external teeth 21*a* and internal teeth 22*a* includes a trochoid curve or a cycloid curve.

DESCRIPTION OF REFERENCE NUMERALS

1: oil
10: housing (pump housing)
20: pump rotor (oil pump rotor)
30, 130, 230: adjustment ring (adjustment member)
34*a*, 35*a*, 134*a*, 234*a*: vane holding portion (seal member holding portion)
36, 81: oil passage
37: foreign matter storage portion
41, 42: vane (seal member)
41*a*, 42*a*: tip
41*b*, 42*b*: root
41*c*, 42*c*: one side surface (side surface)
41*d*, 42*d*: other side face (side surface)
61: leaf spring (urging member)
100, 200: variable oil pump

The invention claimed is:

1. A variable oil pump comprising:

a pump housing;

an oil pump rotor housed in the pump housing and rotationally driven;

an adjustment member housed in the pump housing and that adjusts an amount of oil discharged from the oil pump rotor by being displaced under hydraulic pressure supplied to a hydraulic chamber between the pump housing and the oil pump rotor in a state where the oil pump rotor is rotatably held from an outer peripheral side;

a seal member disposed in a portion where the adjustment member and the pump housing face each other and that seals oil leakage to an outside of the hydraulic chamber;

a seal member holding portion provided in the adjustment member and that holds the seal member; and an oil passage provided in the adjustment member and through which the hydraulic pressure in the hydraulic chamber is drawn into the seal member holding portion, wherein the oil passage extends in a groove shape from a side of a tip of the seal member that slides with respect to an inner surface of the pump housing toward a root of the seal member held by the seal member holding portion.

2. The variable oil pump according to claim 1, wherein the seal member holding portion includes a foreign matter storage portion formed in a vicinity of a root of the seal member and that stores foreign matter contained in the oil drawn from the hydraulic chamber and that flows through the oil passage.

3. The variable oil pump according to claim 2, wherein the foreign matter storage portion is formed in the seal member holding portion so as to extend in a thickness direction of the seal member perpendicular to a direction in which the oil passage extends, and a sectional area of the foreign matter storage portion in a direction perpendicular to a direction in which the foreign matter storage portion extends is larger than a sectional area of the oil passage in a direction perpendicular to the direction in which the oil passage extends.

4. The variable oil pump according to claim 2, further comprising an urging member disposed on the seal member holding portion and that urges the seal member toward an inner surface of the pump housing by pressing the root, wherein the foreign matter storage portion is provided between the oil passage and the urging member.

5. The variable oil pump according to claim 4, wherein the seal member holding portion slidably sandwiches both side surfaces of the seal member, and the foreign matter storage portion is provided in the vicinity of the root corresponding to each of one side surface and the other side surface of the seal member with the urging member as a center.

6. The variable oil pump according to claim 2, wherein the foreign matter storage portion passes through the seal member holding portion along a thickness direction of the seal member.

7. The variable oil pump according to claim 1, wherein the oil passage is formed in a region where the seal member holding portion faces the pump housing on each of one side and the other side in a thickness direction of the seal member holding portion.

* * * * *